US006726040B1

(12) United States Patent
Chen

(10) Patent No.: US 6,726,040 B1
(45) Date of Patent: Apr. 27, 2004

(54) SECTIONAL RACK WITH DRAWERS

(75) Inventor: Henry Chen, Taipei (TW)

(73) Assignee: Protrend Co., Ltd., Taipei (TW)

( * ) Notice: Subject to any disclaimer, the term of this patent is extended or adjusted under 35 U.S.C. 154(b) by 0 days.

(21) Appl. No.: 10/265,464

(22) Filed: Oct. 4, 2002

(51) Int. Cl.[7] ..... A47F 3/06; A47B 57/34

(52) U.S. Cl. ..... 211/187; 211/126.15; 108/147.12; 108/147.13

(58) Field of Search ..... 211/187, 181.1, 211/126.1, 126.15; 108/144.11, 147.11, 147.12, 147.13, 147.14, 147.15, 147.17, 147.18

(56) References Cited

U.S. PATENT DOCUMENTS

| | | | | |
|---|---|---|---|---|
| 3,677,615 A | 7/1972 | Hudson | ..... | 312/334.4 |
| 4,656,952 A | 4/1987 | Schweizer | ..... | 108/147.13 |
| 5,486,046 A | 1/1996 | Jernstrom et al. | ..... | 312/408 |
| 6,257,426 B1 | 7/2001 | Masunaka et al. | ..... | 211/187 |
| 6,357,611 B1 | 3/2002 | Chen | ..... | 211/187 |
| 6,364,138 B1 | 4/2002 | Chen | ..... | 211/187 |

*Primary Examiner*—Daniel P. Stodola
*Assistant Examiner*—Erica B Harris
(74) *Attorney, Agent, or Firm*—W. Wayne Liauh

(57) ABSTRACT

A sectional rack that can be assembled without using any tool and type of fastener includes oblong-sectioned vertical posts having horizontal slots symmetrically provided on two opposite sides, and externally, gradually, downwardly expanding connecting members adapted to firmly attach to the vertical posts through engagement of ribs provided on inner wall surfaces of the connecting members with the horizontal slots on the vertical posts, and horizontal shelves having an internally gradually downward expanded short sleeve provided at each corner and being adapted to connect to the vertical posts by seating the short sleeves over the connecting members attached to the vertical posts. Further, channels are optionally hung on the vertical posts to support drawer-type baskets thereon.

2 Claims, 8 Drawing Sheets

SECTIONAL RACK WITH DRAWERS

BACKGROUND OF THE INVENTION

The present invention relates to a sectional rack, and more particularly to a sectional rack that can be assembled without using any tool and fastening means, and is adapted to firmly hold channels for supporting drawer-type baskets thereon.

There are various types of sectional racks commercially available in the markets. Among these sectional racks, those can be conveniently and quickly assembled without using tools and fastening means are particularly welcome by consumers. U.S. Pat. Nos. 5,676,263; 5,303,645; 5,164,676; 4,991,725; 4,799,817; 4,595,107; 4,546,887; and 4,763,799 all disclose sectional racks that can be assembled without any tool.

A typical structure of the conventional sectional racks is shown in FIG. 1 and includes vertical posts 10, connecting members 11, and horizontal shelves 12. The vertical post 10 is provided with a plurality of vertically spaced annular grooves 13 and therefore has a bamboo-like appearance. The connecting member 11 is provided on an inner wall surface with ribs 14 adapted to engage with the annular grooves 13 and thereby hold the connecting member to the vertical post 10. An outer wall surface of the connecting member 11 gradually expands from top to bottom. The horizontal shelf 12 is provided at each corner with a short sleeve 15 having an inner wall surface gradually expanded from top to bottom corresponding to the inclined outer wall surface of the connecting member 11. When the short sleeves 15 are seated over the connecting members 11 to connect the shelf 12 to the vertical posts 10, they apply a compressive and binding force to the inclined outer wall surface of the connecting member 11 and therefore cause the latter to even firmly attach to the vertical posts 10 at the annular grooves 13.

In the conventional racks having the above-described structure, the horizontal shelves 12 are not forward and backward movable once they are connected to the vertical posts 10. With this structure, it is impossible to use the shelves as a drawer on the sectional rack. There has been developed a drawer-type basket for use on the above-described sectional rack. The basket is supported on rails (not shown) that are provided at front and rear ends with two short sleeves 15 for fixing onto connecting members 11 on posts 10 at two sides of the basket. When the basket is loaded with things and pulled outward, front ends of the rails are subjected to a downward force to cause lifted rear ends of the rails as a result of leverage. At this point, the short sleeves 15 at the lifted rear ends of the rails are not subjected to any downward force from the rear ends of the rails and become loosened from the connecting members 11, and the connecting members 11 have the possibility of separating from the annular grooves 13 of the posts 10 and falling therefrom, causing safety problem in using the sectional rack.

SUMMARY OF THE INVENTION

It is therefore a primary object of the present invention to provide a sectional rack that could not only be assembled without using any tool and fastening means, but also have rails firmly connected thereto for holding drawer-type baskets.

To achieve the above and other objects, the sectional rack of the present invention mainly includes oblong-sectioned vertical posts having horizontal slots symmetrically provided on two opposite side walls, and externally gradually downward expanded connecting members adapted to firmly attach to the vertical posts through engagement of ribs provided on inner wall surfaces of the connecting members with the horizontal slots on the vertical posts, and horizontal shelves having an internally gradually downward expanded short sleeve provided at each corner and being adapted to connect to the vertical posts by seating the short sleeves over the connecting members attached to the vertical posts. And, channels having upward extended L-shaped lugs provided at front and rear ends may be firmly hung on the vertical posts by inserting the lugs into corresponding horizontal slots of the vertical posts, so that a drawer-type basket may be conveniently slidably supported on and between two such channels.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
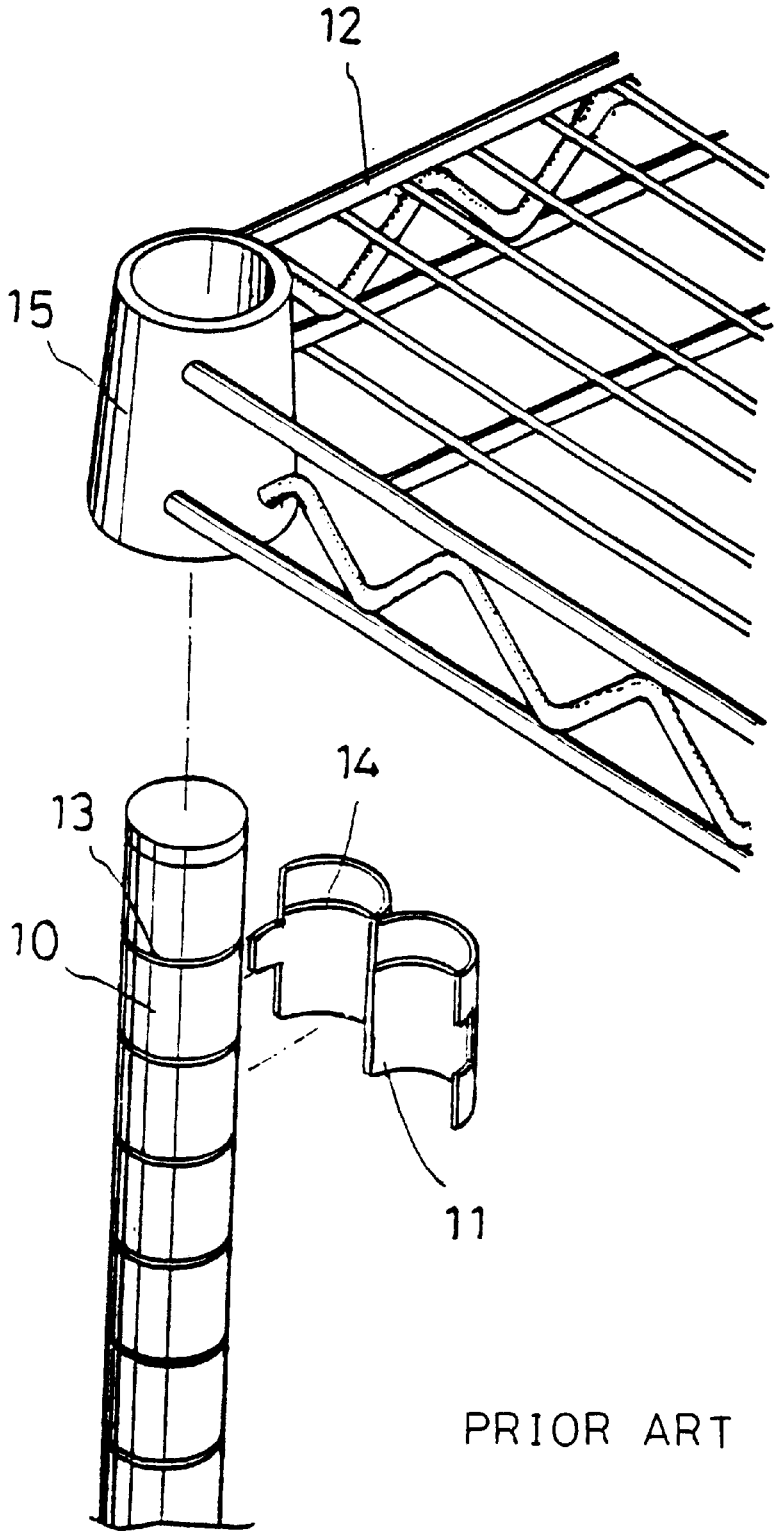
FIG. 1 is an exploded perspective view of a conventional sectional rack having bamboo-like posts.
Figure 2:
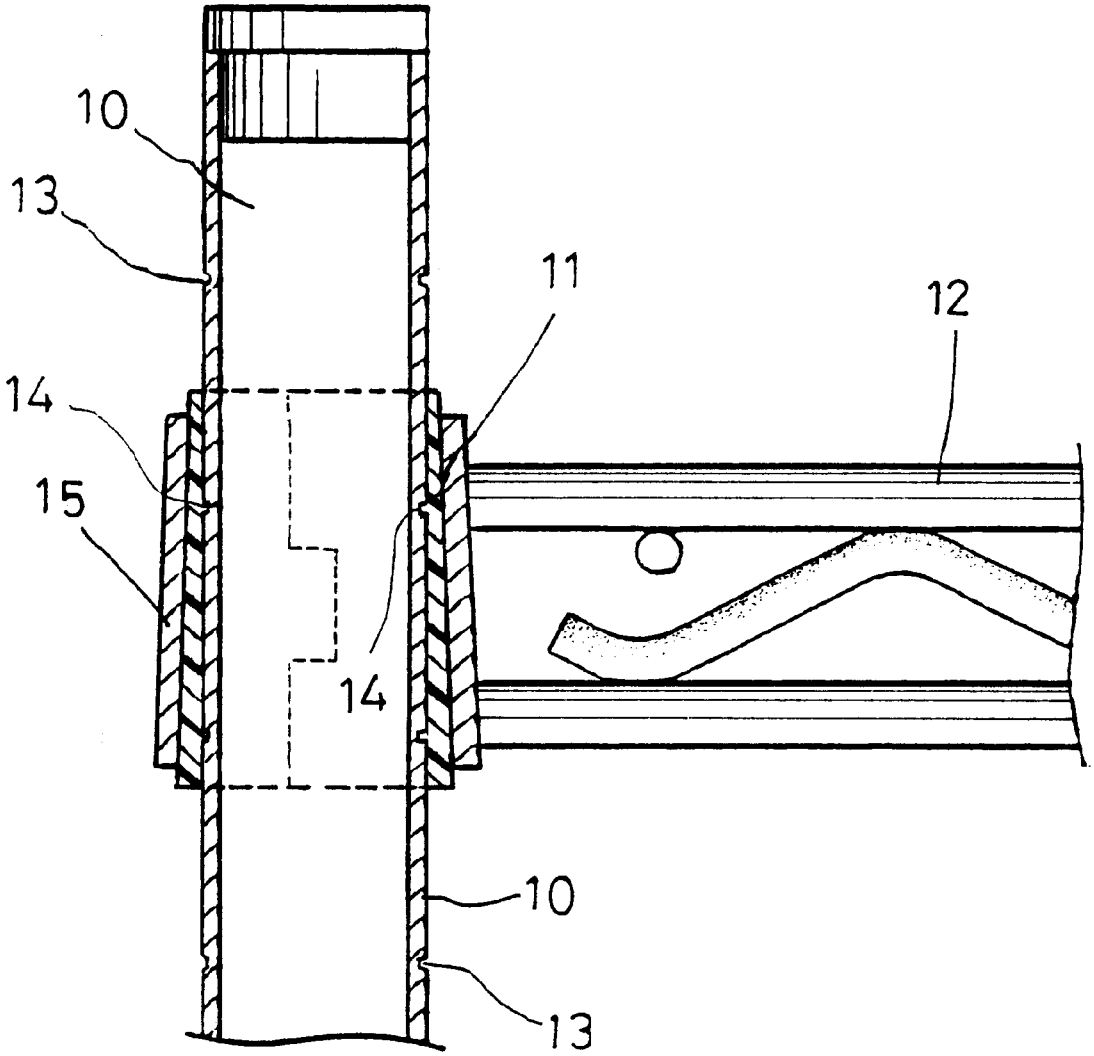
PRIOR ART FIG·2
FIG. 2 is a fragmentary assembled sectional view of the sectional rack of FIG. 1.
Figure 3:
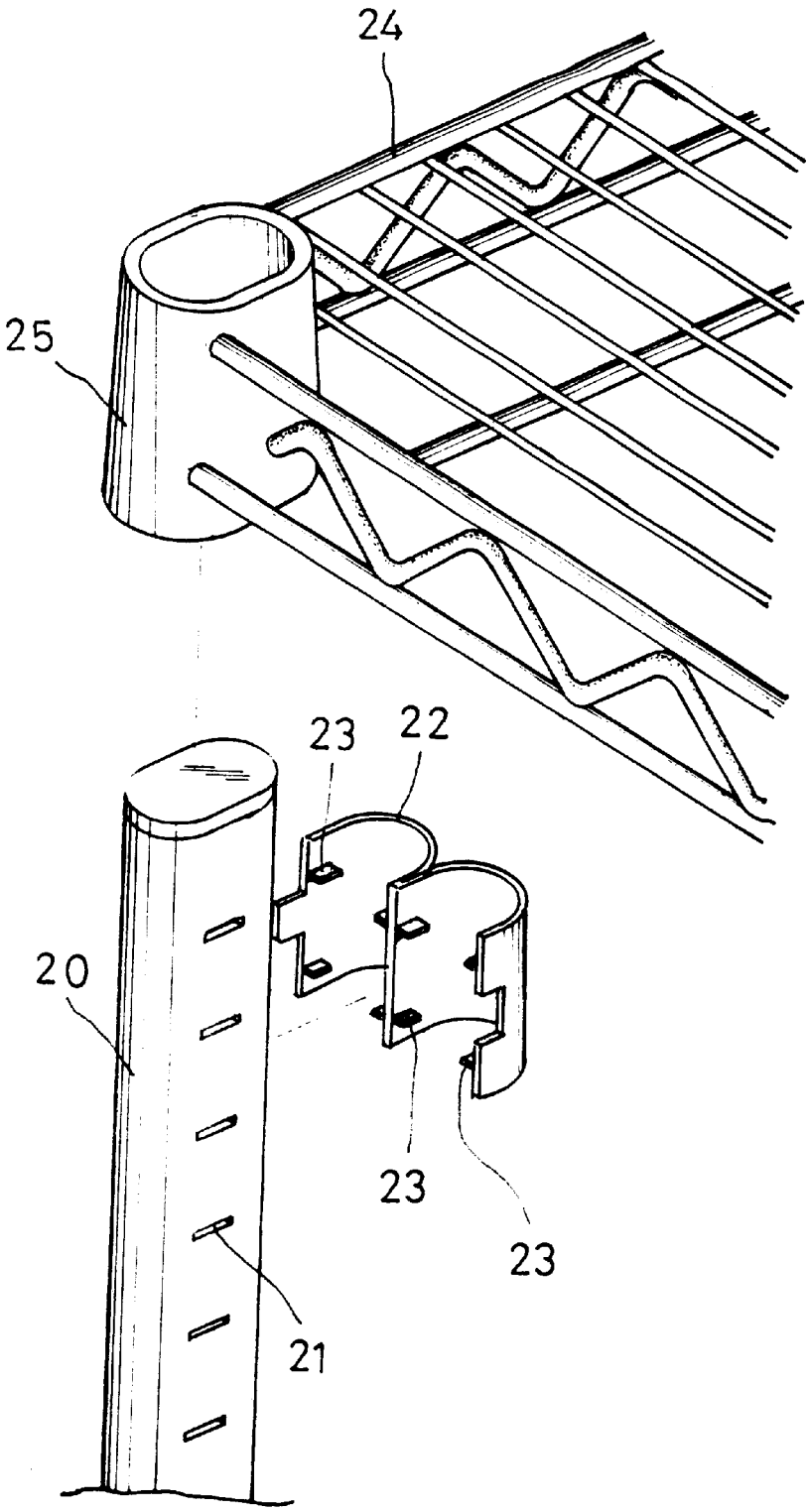
FIG. 3 is an exploded perspective view of a sectional rack according to the present invention showing the assembling of a horizontal shelf to a vertical post of the sectional rack.
Figure 4:
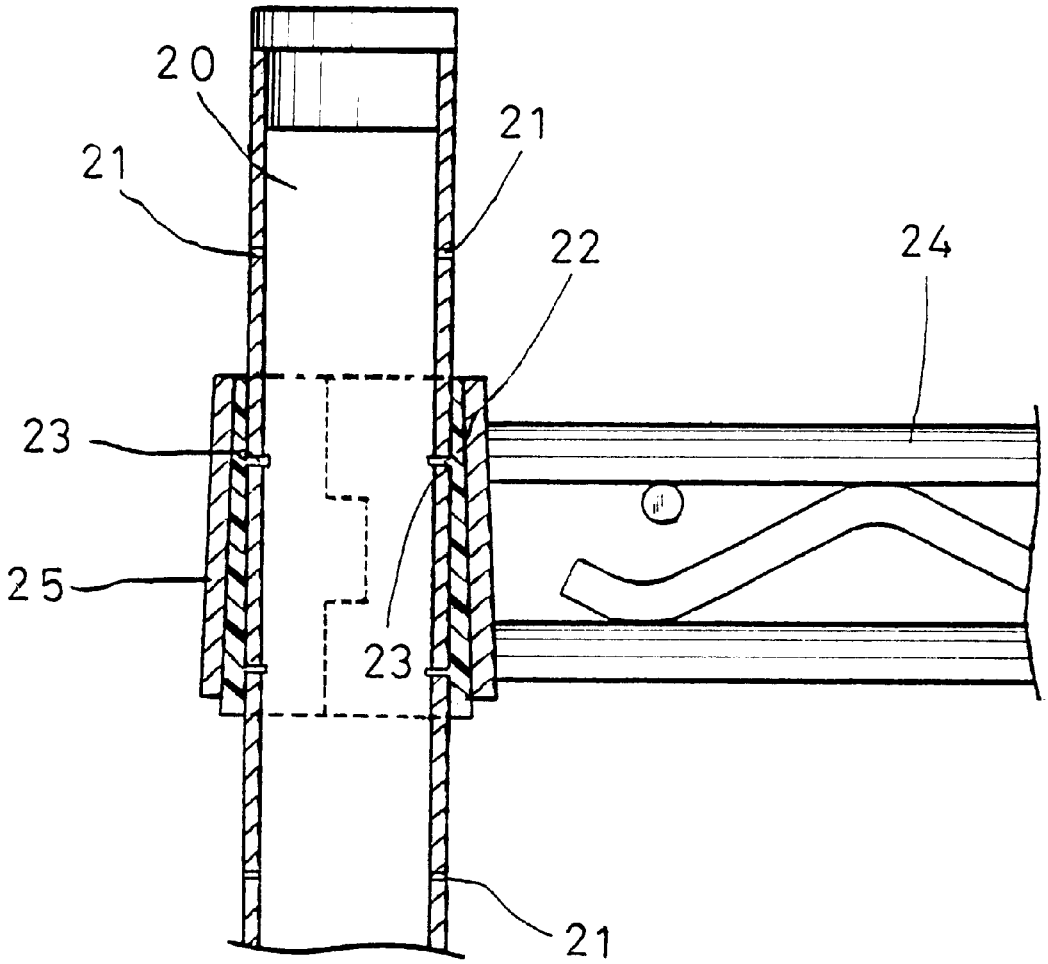
FIG. 4 is a fragmentary assembled sectional view of the sectional rack of FIG. 3.
Figure 5:
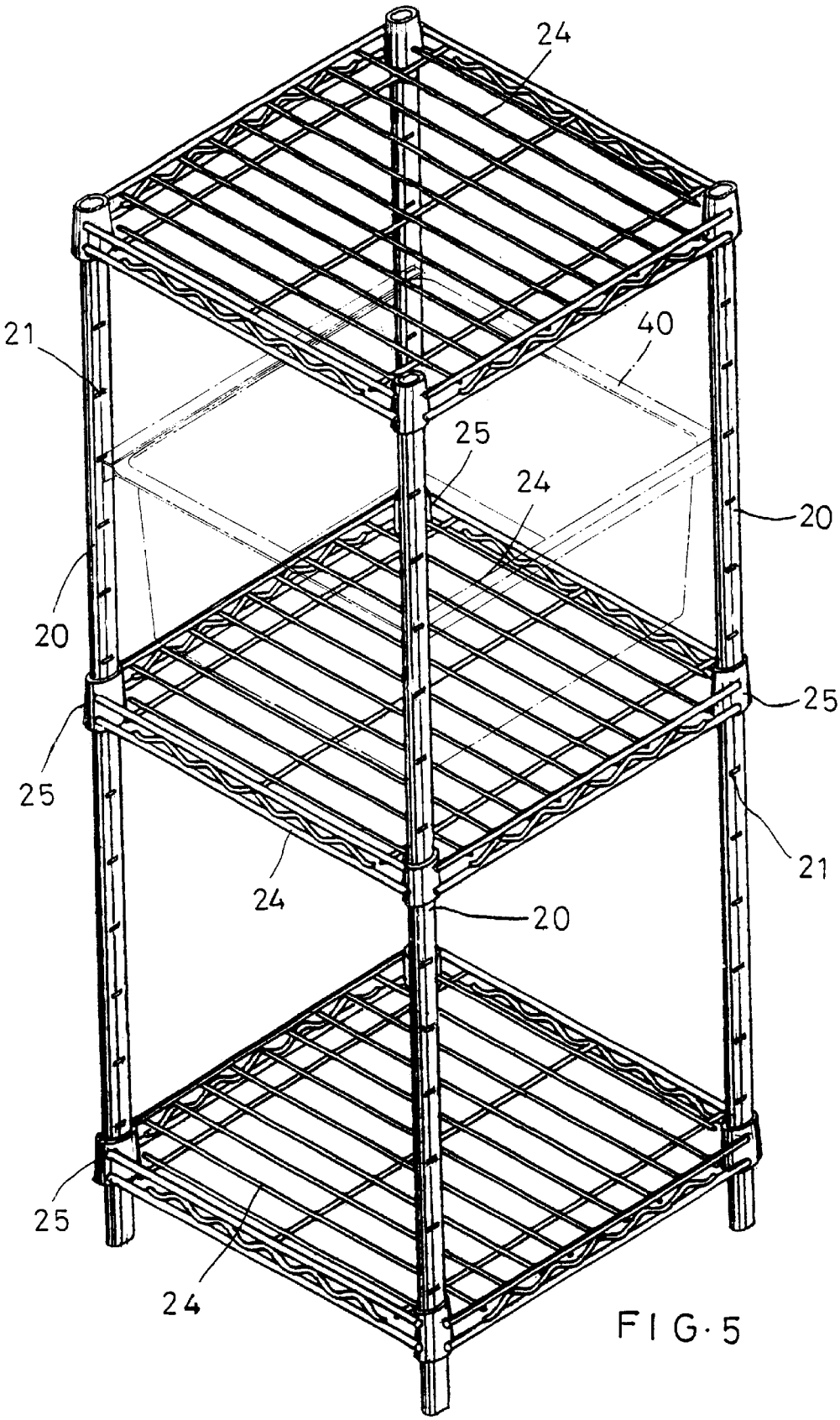
FIG. 5 is a perspective view of an example of the sectional rack of the present invention.

Please refer to FIGS. 3 and 4 that are fragmentary exploded perspective and assembled sectional views, respectively, of a sectional rack according to the present invention, and to FIG. 5 that shows an example of an assembled sectional rack of the present invention. As shown, the sectional rack includes a plurality of vertical posts 20, a plurality of connecting members 22, and a plurality of horizontal shelves 24.

The vertical post 20 has an oblong cross section, and is symmetrically provided at two opposite side surfaces with a plurality of vertically equally spaced horizontal slots 21.

The connecting member 22 includes two integrally connected parts adapted to fitly enclose the oblong-sectioned vertical post 20 and to open and close relative to each other. The two parts of the connecting member 22 are symmetrically provided at inner wall surfaces at predetermined positions with horizontal ribs 23 corresponding to the horizontal slots 21 on the vertical post 20, such that the connecting member 22 can be firmly attached to the vertical post 20 by engaging the ribs 23 with the slots 21. While the connecting member 22 has a straight inner wall surface adapted to fitly bear against an outer surface of the oblong-sectioned vertical post 20, it has a gradually downward expanded outer wall surface.

The shelf 24 is provided at each corner with a short sleeve 25, each of which has a gradually downward expanded inner wall surface corresponding to the gradually downward expanded outer wall surface of the connecting member 22. Whereby when the shelf 24 is connected at four corners to the vertical posts 20 via the short sleeves 25, the short sleeves 25 are separately seated on and downward pressed against the connecting members 22 attached to the horizontal slots 21 of the vertical posts 20, enabling the shelf 24 to firmly locate in place on the sectional rack.

With the horizontal slots 21 symmetrically provided at two opposite sides of the vertical posts 20, the connecting members 22 can be directly attached to the vertical posts 20 for connecting the shelf 24 to the vertical posts 20 without the need of any additional fastening means, such as screws.

Figure 6:
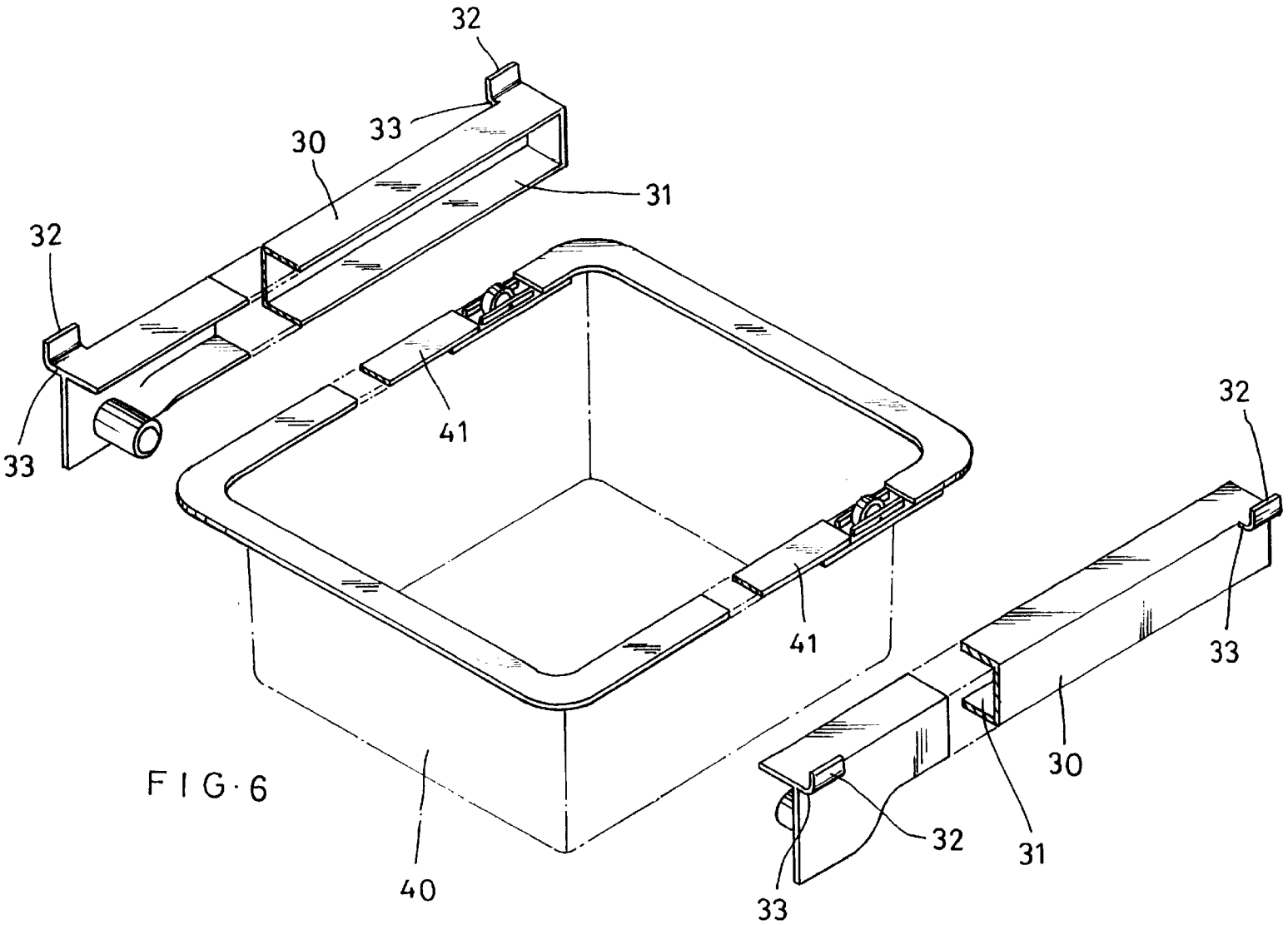
FIG. 6 shows a drawer-type basket and two channels that can be attached to and used with the sectional rack of the present invention.
Figure 7:
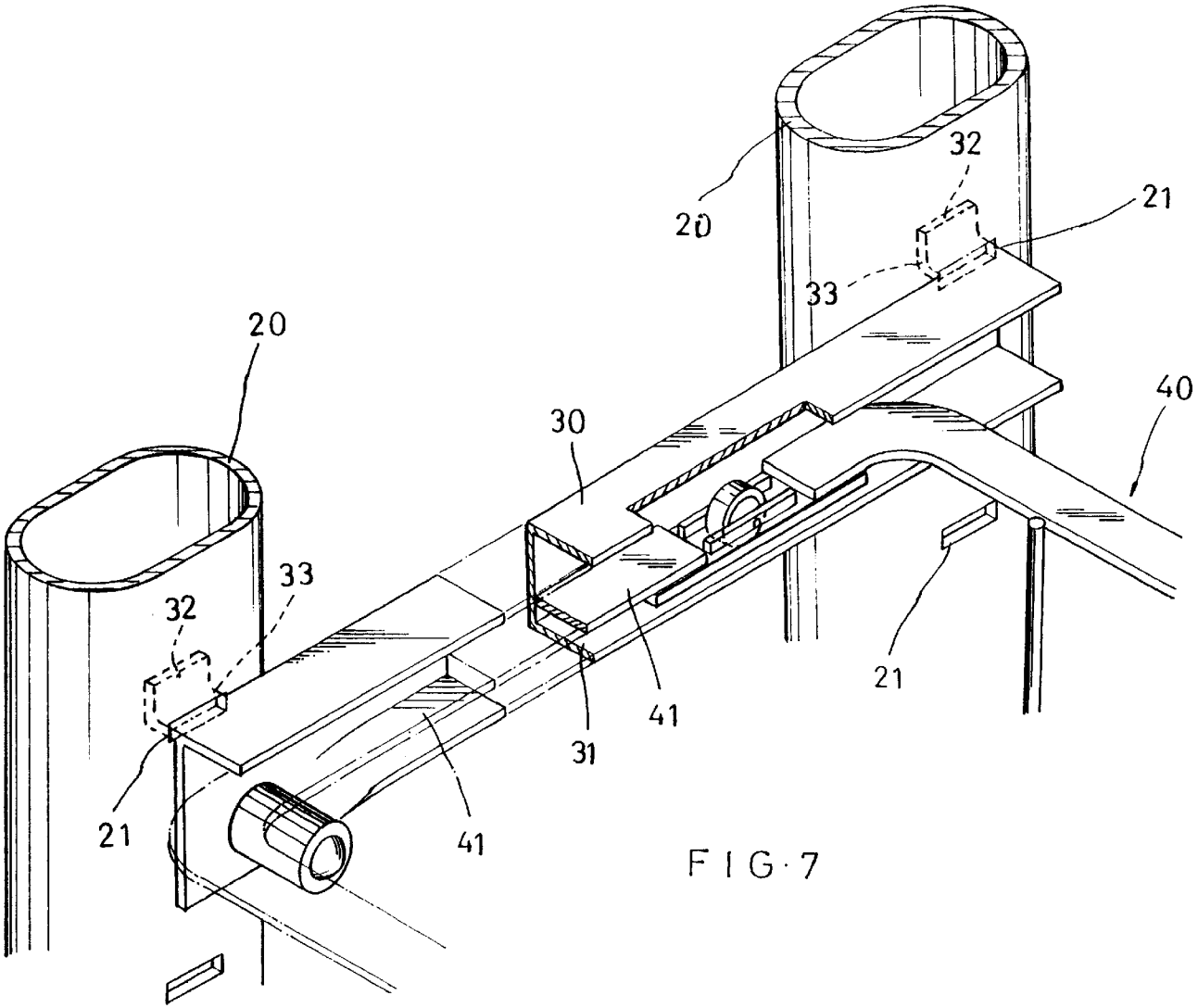
FIG. 7 is an enlarged and partially cutaway perspective view showing the manner of attaching the channel of FIG. 6 to the vertical posts of the sectional rack of the present invention.
Figure 8:
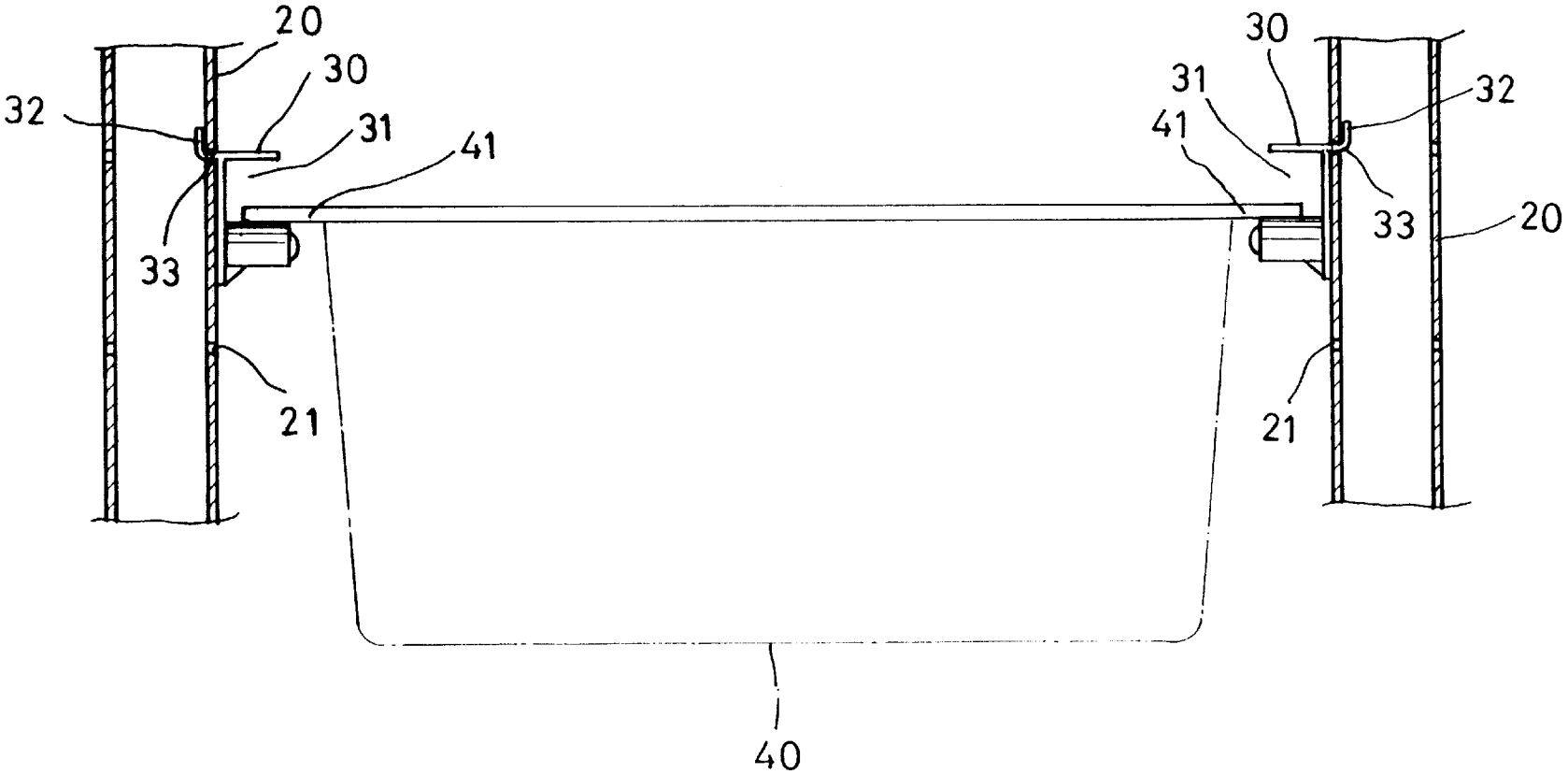
FIG. 8 is a fragmentary sectioned side view showing the vertical posts of the sectional rack of the present invention with channels attached thereto to hold the drawer-type basket.

In the sectional rack shown in FIG. 5, there is included a drawer-type basket 40. An advantage of using the drawer-type basket 40 is items positioned therein are not subjected to unexpected falling. FIG. 6 shows two channels 30 and a basket 40 slidably supported on and between the two channels 30. The channels 30 define two inward opened horizontal guide ways 31. Two L-shaped lugs 32 separately vertically project from upper front and upper rear ends of an outer sidewall of each channel 30 with a horizontal section 33 of each lug 32 extended laterally outward. A distance between the front and the rear lug 32 is the same as that between two horizontal slots 21 correspondingly provided on two vertical posts 20 at the same side of the sectional rack. As can be clearly seen from FIGS. 7 and 8, the channel 30 is fixed to the sectional rack simply by extending the vertical lugs 32 into two corresponding horizontal slots 21 on the two vertical posts 20 at the same side of the sectional rack. The basket 40 is then associated with the channels 30 to locate therebetween by sliding two lateral edges 41 of the basket 40 into the two guide ways 31 defined by the two channels 30.

When the two channels 30 fixed to the sectional rack are subjected to a downward pressure, two outer sidewalls thereof are pressed against inner side surfaces of the two vertical posts 20 to bring the vertical lugs 32 to firmly bear against inner wall surfaces of the posts 20 without the risk of separating from the horizontal slots 21. When the basket 40 is pulled outward along the two guide ways 31 so that rear ends of the two channels 30 are subjected to an upward force, the horizontal sections 33 of the rear lugs 32 are stopped by upper edges of the horizontal slots 21 on the vertical posts 20 from moving upward any further. Therefore, the use of the drawer-type basket 40 would not in any way cause separation or loosening of the two channels 30 from the sectional rack.

The channels 30 may be freely mounted on the sectional rack at any vertical position on the posts 20, and the basket 40 may have sidewalls of any height to meet actual need. The sectional rack of the present invention may be assembled without using any tool, and the two channels 30 are conveniently and quickly connected to the rack without the need of using any screws or other fastening means.

What is claimed is:

1. A sectional rack, comprising a plurality of vertical posts, a plurality of horizontal shelves, a plurality of connecting members, and a plurality of drawer-type baskets and channels for supporting the baskets;

each said vertical post having an oblong cross section and being symmetrically provided at two opposite side surfaces with a plurality of identical, vertically equally spaced, horizontal slots;

each said connecting member being symmetrically provided on two opposite straight inner wall surfaces with two pairs of ribs adapted to engage with said horizontal slots on two opposite sides of said vertical post and thereby attach said connecting member to said vertical post, and said connecting member having an outer wall surface gradually expanded from top to bottom; and each said shelf being provided at each comer with a short sleeve having an inner wall surface gradually expanded from top to bottom corresponding to said outer wall surface of said connecting member, such that said short sleeve could be seated over said connecting member to generate a downward compressive and binding effect on said connecting member and thereby hold said shelf to said vertical post at said connecting member wherein each of said channels has two vertically upward extending L-shaped lugs, and said horizontal slots are constructed to also allow said L-shaped lugs to be inserted therein so as to hang said channels on said vertical post, wherein each of said horizontal slots is configured to selectively receive each of the ribs of said connecting members and the lugs of each said channel to enable each of the shelves and the drawing baskets to be mounted at any location along the length of the vertical post.

2. The sectional rack as claimed in claim 1, wherein each said channel defines an inward opened guide way along which a lateral edge of said basket is slidably moved, and is provided at upper front and upper rear ends of an outer sidewall with said two vertically upward extended L-shaped lugs, a distance between said front and said rear lugs being the same as that between two said horizontal slots correspondingly provided at the same vertical position on two said vertical posts located at the same side of said sectional rack, and said channel being fixed to said sectional rack by inserting said front and said rear lugs into two said horizontal slots correspondingly provided at the same height on two said vertical posts located at the same side of said sectional rack.

* * * * *